United States Patent [19]

Sperry et al.

[11] 3,948,323

[45] Apr. 6, 1976

[54] THERMAL INJECTION PROCESS FOR RECOVERY OF HEAVY VISCOUS PETROLEUM

[75] Inventors: John S. Sperry; Richard W. Krajicek; Dudley P. South, Jr., all of Houston, Tex.

[73] Assignee: Carmel Energy, Inc.

[22] Filed: July 14, 1975

[21] Appl. No.: 595,434

[52] U.S. Cl. ..... 166/303

[51] Int. Cl.[2] ..... E21B 43/24

[58] Field of Search ..... 166/303, 263, 272, 302, 166/57, 261, 252

[56] References Cited

UNITED STATES PATENTS

| | | | |
|---|---|---|---|
| 2,173,556 | 9/1939 | Hixon | 166/272 |
| 2,823,752 | 2/1958 | Walter | 166/272 |
| 2,839,141 | 6/1958 | Walter | 166/261 |
| 3,360,044 | 12/1967 | Lange | 166/272 |
| 3,385,360 | 5/1968 | Smith | 166/303 X |
| 3,425,492 | 2/1969 | Gilchrist | 166/272 |
| 3,480,081 | 11/1969 | Felsenthal et al. | 166/272 X |
| 3,499,490 | 3/1970 | Needham et al. | 166/272 X |
| 3,789,470 | 1/1974 | West et al. | 166/303 |

*Primary Examiner*—Stephen J. Novosad
*Attorney, Agent, or Firm*—Pravel & Wilson

[57] ABSTRACT

A new and improved process for the recovery of heavy viscous petroleum from a subterranean formation is disclosed. A heated fluid comprising steam and a heated non-condensable gas is injected into the formation through a penetrating well at an initial predetermined injection rate until the injection rate diminishes to a predetermined level. The injection is then discontinued and a heated non-condensable gas is immediately injected into the formation through the well until the injection rate thereof reaches a desired level. The steam-gas mixture and heated non-condensable gas are then alternately injected in sequence until the steam-gas mixture can be injected into the formation continuously at a desired injection rate and the formation and petroleum have been heated to a predetermined extent. The heated, mobile petroleum is then recovered by withdrawal through the well in a conventional manner. The process is particularly useful for the recovery of heavy viscous petroleum from a formation having low permeabilities to oil and water.

9 Claims, 1 Drawing Figure

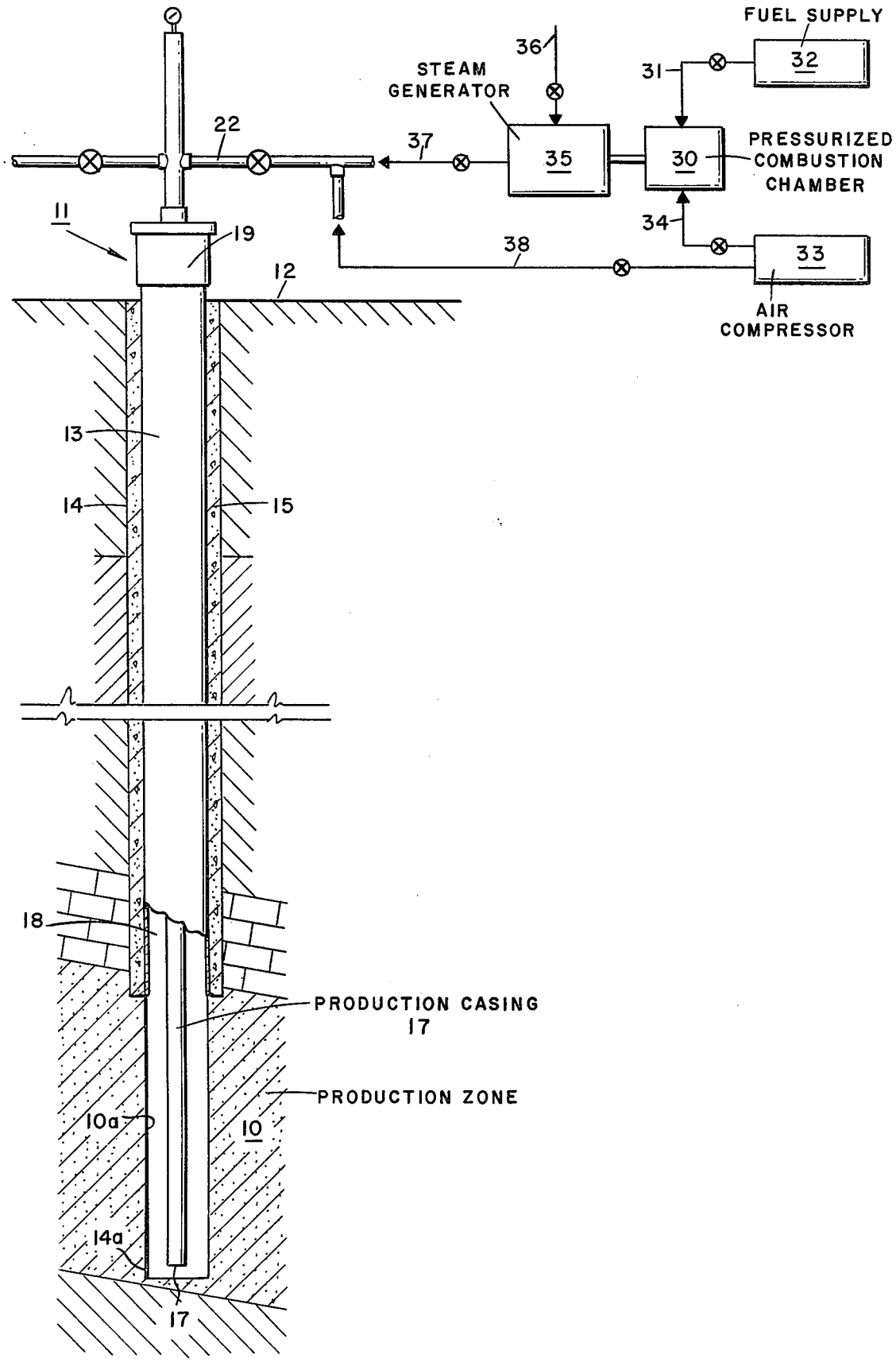
FUEL SUPPLY
32
36
31
STEAM GENERATOR
22
37
35
30
PRESSURIZED COMBUSTION CHAMBER
11
19
34
38
33
12
AIR COMPRESSOR
13
14
15
18
PRODUCTION CASING
17
PRODUCTION ZONE
10a
10
14a
17

THERMAL INJECTION PROCESS FOR RECOVERY OF HEAVY VISCOUS PETROLEUM

BACKGROUND OF THE INVENTION

1. Field of the Invention

This invention relates to the recovery of petroleum from a subterranean formation and more particularly pertains to a new and improved process for heating a petroleum-bearing formation by injecting thermal energy therein for recovering the heavy viscous petroleum therefrom.

2. Description of the Prior Art

Through the years many processes have been developed for recovering heavy viscous petroleum from petroleum-bearing formations to reduce the petroleum viscosity by elevating its temperature. As known, viscosity reduction increases the mobility of the petroleum through the formation thereby enabling it to be withdrawn by conventional techniques such as natural flow, pumping, etc. Such thermal introduction processes have employed thermal energy in a wide variety of forms, such as hot water, in-situ combustion, steam, heated condensable and non-condensable gases, and the like. However, steam, either alone or in combination with other thermal energy agents, has been the most widely employed for it has been found to be the most efficient and economical.

Generally speaking, there are two basic processes or techniques for introducing steam into a formation for increasing the recovery of heavy viscous petroleum. One technique is usually referred to as "steam drive" or the like wherein steam is injected into a formation by means of an injection well. The injected steam heats the formation and viscous petroleum and drives the heated petroleum toward one or more adjacent producing wells which are employed to withdraw it to the surface. The second basic technique is commonly referred to as "single well injection," "huff-and-puff" or the like wherein the steam is injected into a formation through a single injection well in a predetermined quantity (huff phase), the formation is allowed to "soak" during which the heat permiates, heating a larger volume of the reservoir, and the heated, mobile petroleum is then produced or withdrawn from the formation through the same well (puff phase).

There are, of course, many modified versions of these basic steam injection techniques known in the art. Many of such processes include the injection of other materials along with or alternately with steam into the formation. By way of example, see U.S. Pat. Nos. 3,292,702; 3,409,083; 3,500,931, and 3,782,470 which disclose modified versions of the above "huff-and-puff" single well steam injection technique.

Many of the known steam injection techniques have been useful in the recovery of certain types of crudes under certain conditions. However, there are several formations known to contain heavy viscous petroleum from which the petroleum has not been recovered in any great quantities by the employment of any known process, including the steam injection processes. These formations are saturated with heavy viscous petroleum usually having API gravities of below about 22° (at 60°F.) and viscosities greater than about 200 centipoise (at 60°F.). Further, many of these formations have low relative permeabilities to oil and water such that they will not accept the direct injection of heated fluids containing steam at sufficiently high injection rates to permit economic recovery of the heavy viscous petroleum. Specific examples of such low relative permeability formations containing such heavy viscous crudes include Pennsylvanian sandstones, such as the Bartlesville sandstone, of the Cherokee group, located in southern Illinois, western Missouri, southeastern Kansas and eastern Oklahoma. Previous attempts to recover such heavy viscous crudes from such formations having low relative permeabilities to water and oil by the employment of known steam injection techniques have heretofore proven unsuccessful inasmuch as such techniques have been incapable of introducing sufficient heat into the formations to permit the recovery of sufficient quantities of the petroleum for economical operation.

Accordingly, it is a principal object of the present invention to provide a process for the recovery of heavy viscous petroleum, particularly crudes having API gravities of below about 22° (at 60°F.), and viscosities greater than about 200 centipoise (60°F.), from formations having low relative pemeabilities to oil and water.

It is another object of the present invention to provide a process for injecting sufficient quantities of heat into such formations having low relative permeabilities to oil and water to permit economic recovery of such heavy viscous crudes contained therein.

It is yet another object of the present invention to provide a process for injecting a heated fluid containing steam into a petroleum-bearing formation having low relative permeabilities to oil and water, in sufficient quantities and at high injection rate, to permit the recovery of heavy viscous crudes therefrom efficiently and economically.

It is yet another object of the present invention to provide a new and improved single well steam injection process for the recovery of such heavy viscous petroleum from such formations having low relative permeabilities to oil and water.

Other objects and advantages of the present invention will become readily apparent to those having ordinary skill in the art from reading this specification and claims in detail.

SUMMARY OF THE INVENTION

The above objects of the present invention are accomplished by initially injecting a heated fluid comprising steam and a heated non-combustible gas into a formation having low relative permeabilities to oil and water containing the heavy viscous petroleum at a predetermined initial injection rate to heat the formation and the petroleum and increase the mobility thereof for recovery. The heated fluid is continuously injected into the formation until the injection rate diminishes to a predetermined level. The injection is then discontinued and a heated non-condensable gas is then substantially immediately injected into the formation to drive heat and any condensed liquids through the formation away from the well bore to permit the heated fluid to be reinjected at a desired injection rate. After the injection rate of the heated non-condensable gas reaches a predetermined level, injection of the heated fluid into the formation is reinstated. The heated fluid and heated non-condensable gas are alternately injected in sequence until the heated fluid can be injected substantially continuously at a predetermined desired rate and until the formation and petroleum contained therein have been heated to a predetermined extent. The heated, mobile petroleum is then withdrawn from the formation through the well in the conventional manner such as natural flow, pumping, etc.

DESCRIPTION OF THE DRAWINGS

The FIGURE is a schematic drawing, partially in cross-section, of a section of the earth illustrating a well penetrating a petroleum-bearing formation and means at the surface for introducing the steam-gas mixture and a heated non-condensable gas into the well and formation in accordance with the process of the invention.

DETAILED DESCRIPTION OF THE INVENTION

While the process of the invention may be employed for the recovery of substantially any type of crude from substantially any type of subterranean petroleum-bearing formation, it is particularly useful for economically and efficiently recovering heavy viscous crudes having API gravities of below about 22° and viscosities greater than about 200 cp (both at 60°F.). The inventive process is especially useful for recovering these highly viscous crudes from formations which have such low relative permeabilities to water and oil that they will not accept direct steam injection at pressures below formation fracture gradient pressures at high formation injection rates. Such formations usually have an absolute permeability to air averaging within the range of from about 50 to about 2,000 md; however, the relative permeabilities to water and oil may be less 1% of the absolute permeability. These low relative permeability viscous crude-bearing formations are well-known to those having ordinary skill in the art of thermal recovery and include the above-mentioned Pennsylvanian sandstones.

The practice of this invention can perhaps be most easily understood by reference to the drawing. As illustrated, the formation 10 bearing a heavy viscous petroleum is penetrated by a well shown generally at 11 which has been drilled from the surface of the earth 12. The well has preferably been completed in a conventional manner and includes a string of casing 13 set within a bore hole 14 to the top of the petroleum-bearing formation 10 and supported by a cement sheath 15. The bore hole 14 penetrates the formation and preferably has been drilled to near the bottom of the surrounding formation injection zone. The well bore 14 lower portion **14*a* penetrating the formation 10 may be left open as in a conventional open-hole completion or a screen, slotted lines or like perforated device may be set in the bore lower portion 14*a*** to support the well bore walls.

The well 11 also includes a string of tubing 17 disposed within the annular casing 13 and well bore lower portion 14a for injecting the steam-gas mixture and heated non-condensable gas into the formation 10 and for withdrawing the resulting heated petroleum to the surface by the employment of conventional petroleum producing means, such as a pump or the like (not shown). The tubing 17 and annular casing form an annulus 18 which may have a conventional packer assembly (not shown) to seal of the annulus 18 and maintain formation pressure.

The heated fluid employed in the process of the invention may be any mixture of steam and any non-condensable, such as carbon dioxide, nitrogen, combustion gases, and the like. However, we prefer to employ a mixture of steam and combustion gases which is essentially free of solid carbonaceous particles inasmuch as such a mixture can be produced relatively economically. Additionally, as known, steam has a high specific heat content and we have found that the combustion gases admixed therewith aid in driving the steam and heat through a formation having low relative permeabilities to oil and water.

The mixture of steam and combustion gases may be produced and injected into the formation by any process known in the art employing any known apparatus. However, as illustrated in the drawing, we prefer to produce the mixture by burning a fluid hydrocarbon fuel, such as diesel oil, fuel oil, propane, butane, natural gas, crude, etc., under high pressure in a pressurized combustion chamber 30 in the presence of a high pressure stream of air. The hydrocarbon fuel may be injected into the pressurized combustion chamber 30 through pipe 31 from a suitable fuel supply chamber 32 and the high pressure air stream may be provided by a suitable air compressor 33 connected by proper piping 34. Such pressurized burning forms a pressurized stream of combustion gases which is then transferred to a steam generator 35 by suitable means. The pressurized stream of combustion gases is preferably essentially free of solid carbonaceous particles provided by essentially complete fuel combustion under pressure and has a temperature of approximately 2,000-3,000°F. upon leaving the pressurized combustion chamber 30. Upon entering the steam generator 35 the pressurized combustion gas stream is contacted with water in any conventional manner supplied to the steam generator 35 through suitable piping 36 thereby resulting in the formation of a pressurized stream of steam and combustion gases. This pressurized steam-combination gas admixture can then be injected into the well 11 through suitable valve-controlled piping 37 connected with the well tubing 17 by means of a valve controlled well injection pipe 22.

In accordance with the process of the invention, the steam-combustion gas mixture is injected into the well injection pipe 22 through the well tubing 17 and into the formation 10 at the maximum injection rate possible without exceeding the formation fracture gradient pressure. More specifically, we prefer to inject the steam-gas mixture into the formation at a maximum pressure below the formation fracture gradient pressure, usually within the range of from about 200 to about 1500 psig, at a temperature within the range of from about 200°F. to about 600°F., especially about 375°–525°F. This usually results in an initial injection rate of from about 20 million to about 250 million BTU heat per day, and from about 100,000 to about 2 million standard cubic feet of fluid per day, depending upon formation permeability, porosity, per cent petroleum saturation, formation temperature and pressure, and the like. The steam-gas mixture is continously injected into the formation, preferably at as high a pressure as practicable, to maintain a maximum injection rate. During injection, the steam-gas mixture is forced outwardly through the interstices of the formation from the well bore lower portion 14a transferring latent heat to the formation and viscous crude thereby elevating their temperatures. However, upon transference of latent heat, the steam condenses of water which is essentially blocked from moving outwardly from the well bore through the formation due to the formation's low relative permeability thereto. Further, during injection the heated petroleum adjacent the well bore becomes mobile and is forced outwardly therefrom through the formation where it contacts the cooler portions of the formation and is rapidly cooled. This rapid cooling increases its viscosity in the formation interstices and causes further blockage to steam penetration. The blockage of the formation interstices by the cooling crude and condensed water thus causes the formation injection rate of the steam-gas mixture to rapidly diminish.

In accordance with the present invention, the injection of the steam-gas mixture is immediately discontinued when its injection rate diminishes to a level of from about 1/10 to about ½ of its initial injection rate. The injection of the non-condensable gas is then immediately begun, as explained hereafter. It has been found that it is extremely critical in the practice of the present invention to immediately discontinue the injection of the steam-gas mixture and immediately begin injection of the heated noncondensable gas when the steam-gas mixture injection rate diminishes to about ½ to about 1/10 the initial injection rate. Experimentation has shown that reinstatement of injection of the steam-gas mixture at any practicable injection rate is extremely difficult, if not impossible, to obtain if the injection rate is allowed to diminish below about ½ to 1/10 the initial steam-gas injection rate. When this occurs, reconditioning the formation, such as by washing the face of the formation with a suitable technique known in the art, is usually required before the steam-gas mixture can be further injected therein at any practicable injection rate.

The heated non-condensable gas is then injected through the well 11 into the formation 10, preferably at the maximum rate possible under the formation fracture gradient pressure, continously until the gas injection rate rises to a desired level, usually within the range of from about 100,000 to about 2 million standard cubic feet per day. Surprisingly, we have found that the alternate injection of the heated non-condensable gas into the formation reestablishes and further increases the injection rate of the gas-steam mixture. The heated non-condensable gas is capable of passing through the formation interstices which are plugged or otherwise blocked to passage of the steam-gas mixture. Thus, the injected heated gas reheats the viscous petroleum which has moved outwardly through the formation from the well bore, as described hereinabove, thereby removing plugging of the formation interstices to the gas-steam mixture. Further, injection of the heated gas forces condensed water from the steam-gas mixture injection outwardly through the formation interstices.

The injected gas preferably has a temperature within the range of from about 100° to about 400°F., especially about 300°F., and is preferably injected at a maximum pressure below the formation fracture gradient pressure, usually within the range of from about 200 to about 1500 psig. The particular type of heated gas is not critical, so long as it is non-condensable. However, we prefer to employ heated air, nitrogen, carbon dioxide or mixtures thereof. For economic reasons, we especially prefer to employ heated air. As illustrated in the drawing, heated air can be readily injected into the formation 10 through the well 11 by passing heated air from the compressor 33 through a by-pass line 38 which is connected to the injection pipe 22. The compressor 33 heats the air from about 100° to about 400°F. during compression and can provide an injection pressure of from about 200 to about 1500 psig, the preferred temperature and injection pressures described hereinabove.

After the injection rate of the heated non-condensable gas has increased to the desired level, within the above-mentioned range of from about 100,000 to about 2 million scfd, gas injection is discontinued and injection of the steam-gas mixture is reinstated at the maximum injection rate possible employing a maximum pressure below the formation fracture gradient pressure. In the event the gas-steam mixture reinjection rate diminishes to about ½ to 1/10 the initial injection rate again, injection of the heated, noncondensable gas is reinstated. These injection steps are repeated in sequence until the steam-gas mixture can be injected into the formation substantially continuously at an injection rate within the range of from about 20 million to about 250 million BTU heat per day. Our experience has shown that this is usually accomplished after three cycles of alternate injection of the steam-gas mixture and heated non-condensable gas. Surprisingly, after each alternate cycle, the injection rate of the steam-gas mixture becomes more stabilized and graduially increases.

After the steam-gas mixture injection rate has been stabilized to within the above-mentioned desired range, injection is continued for a desired period of time to permit the recovery of an economical volume of petroleum. The heated, mobile petroleum is then withdrawn from the formation 10 through the injection well 11 by employing conventional techniques, such as natural flow, pumping, and the like. If desired, the formation may be allowed to "soak" for a desired length of time before the petroleum is withdrawn to allow the heat to penetrate through the formation interstices. "Heat soaking" the formation is a well-known technique and, therefore, will not be described more particularly herein.

The process of the invention has been found to be particularly useful for recovering viscous crudes having API gravities of less than 22° API at 60°F. and viscosities greater than about 200 cp at 60°F. from Pennsylvanian sandstone formations, particularly the Bartlesville sandstone of the Cherokee group located in the Carlysle Pool near Iola, Kansas. This particular formation tested was a hard sandstone with 24% porosity containing a 19° API gravity crude with 72% oil saturation. The crude had a viscosity of about 1000 cp (60°F.) and the formation had an absolute permeability to air ranging from about 400 md to about 1,200 md, with an average of 698 md. Production of crude from the formation by pumping amounted to only 0.5–1 barrel of crude per day. Previous attempts to increase the crude recovery by direct single well steam injection were unsuccessful, inasmuch as the steam injection rate rapidly diminished to zero after approximately 12 hours of injection, thereby preventing injection of sufficient heat. However, by employing the above-described inventive process, we were able to increase the production rate of the crude to about 20 barrels crude per day, a 2000 % increase in production rate.

It is to be understood that the pressures and temperatures contemplated by this inventive process will vary with the specific formation to be treated, rock properties, petroleum properties, the temperatures required to reduce the viscosity of the petroleum to the desired level, etc. all of which problems are known to those skilled in the art. Further, also the inventive process is particularly useful as described, it will be readily apparent to the skilled artisan that it may be employed in recovering viscous crudes from many types of known low permeability formations.

Having thus described our invention, we claim:

1. A method for recovering heavy viscous petroleum from a subterranean formation penetrated by an injection well, said method comprising:

a. injecting a heated fluid comprising steam and a heated non-condensable gas into the hydrocarbonaceous subterranean formation through the well to elevate the temperature of the heavy viscous petroleum contained therein for increasing its mobility, said heated fluid being injected into the formation at a predetermined initial injection rate under a pressure below the formation fracture gradient pressure until the heated fluid injection rate diminishes to a predetermined level;

b. discontinuing the injection of the heated fluid into the formation and substantially immediately injecting a heated non-condensable gas into the formation through the well to drive heat outwardly through the formation from the well to prevent formation blockage of movement of the heated fluid through the formation, said heated non-condensable gas being injected into the formation at a pressure below the formation fracture gradient pressure continuously until the injection rate thereof reaches a predetermined desired level; and c. repeating steps (a) and (b) in sequence until said formation and petroleum contained therein are heated to a predetermined extent.

2. The process of claim 1 wherein the heated fluid comprising steam and a heated non-condensable, non-oxidizing gas is injected continuously into the formation until the injection rate thereof diminishes to about one-half to about one-tenth of the predetermiined initial injection rate.

3. The process of claim 1 wherein the heated fluid is initially injected into the formation through the well at an initial injection rate of from about 20 million to about 250 million BTU heat per day.

4. The process of claim 1 wherein the heated non-condensable gas has a temperature of from about 150°F. to about 400°F. and is injected into said formation through the well under a pressure of about 200 to about 1500 psig continuously until the injection rate of said gas into the formation is within the range of from about 100,000 to about 2 million standard cubic feet per day.

5. The process of claim 4 wherein the heated non-condensable gas is one selected from the group consisting of air, nitrogen, carbon dioxide and mixtures thereof.

6. The process of claim 1 wherein a. the heated fluid comprises a mixture of steam and combustion gases produced by combusting a petroleum-derived fuel in the presence of air under a pressure within the range of from about 200 to about 1500 psig, said mixture being essentially free of solid carbonaceous particles, and b. wherein said heated fluid is injected into the formation at a temperature within the range of from about 200 to about 600°F. under a pressure within the range of from about 200 to about 1500 psig.

7. The process of claim 1 wherein a. the steps (a) and (b) are repeated in sequence until the heated fluid can be injected into the formation substantially continuously at a formation injection rate substantially equal to the predetermined initial injection rate; and b. continuously injecting the heated fluid into the formation until the formation and petroleum contained therein have been heated to a predetermined extent.

8. The process of claim 1 wherein the petroleum has an API gravity below about 22° at 60°F. and a viscosity greater than about 200 centipoises at 60°F.

9. The process of claim 8 wherein the formation is a Pennsylvanian sandstone.

* * * * *

UNITED STATES PATENT AND TRADEMARK OFFICE

CERTIFICATE OF CORRECTION

PATENT NO. : 3,948,323

DATED : April 6, 1976

INVENTOR(S) : John S. Sperry; Richard W. Krajicek; Dudley P. South, Jr.

It is certified that error appears in the above-identified patent and that said Letters Patent are hereby corrected as shown below:

On the cover page delete the schematic electrical circuit diagram and substitute therefor the figure of the issued patent, as shown on the attached sheet.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*

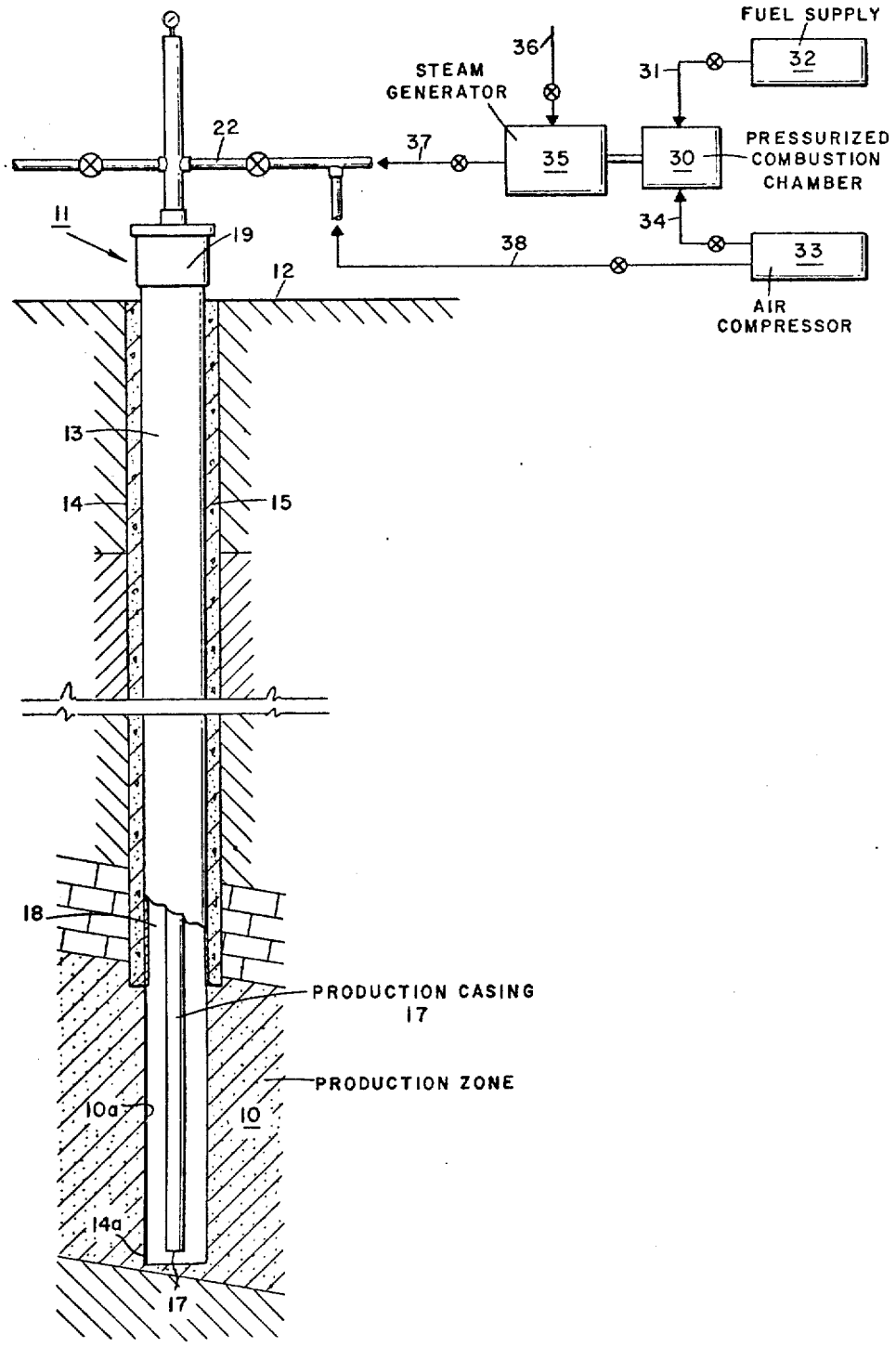
FUEL SUPPLY
32
36
31
STEAM GENERATOR
35
30
PRESSURIZED COMBUSTION CHAMBER
37
22
11
19
34
38
33
12
AIR COMPRESSOR
13
14
15
18
PRODUCTION CASING 17
PRODUCTION ZONE
10a
10
14a
17